US010211038B2

(12) United States Patent
Nagata et al.

(10) Patent No.: US 10,211,038 B2
(45) Date of Patent: Feb. 19, 2019

(54) METHOD FOR SUPPLYING GAS FOR PLASMA BASED ANALYTICAL INSTRUMENT

(71) Applicant: Agilent Technologies, Inc., Santa Clara, CA (US)

(72) Inventors: Yoichi Nagata, Tokyo (JP); Shusaku Tsuruga, Kanagawa-Ken (JP); Takeo Kuwabara, Tokyo (JP); Ryosuke Tobiyama, Tokyo (JP)

(73) Assignee: Agilent Technologies, Inc., Santa Clara, CA (US)

( * ) Notice: Subject to any disclaimer, the term of this patent is extended or adjusted under 35 U.S.C. 154(b) by 58 days.

(21) Appl. No.: 15/418,039

(22) Filed: Jan. 27, 2017

(65) Prior Publication Data

US 2017/0221688 A1 Aug. 3, 2017

(30) Foreign Application Priority Data

Jan. 29, 2016 (JP) ..... 2016-015106

(51) Int. Cl.
*H01J 49/04* (2006.01)
*H01J 49/10* (2006.01)

(52) U.S. Cl.
CPC ..... *H01J 49/0422* (2013.01); *H01J 49/105* (2013.01)

(58) Field of Classification Search
CPC .. H01J 15/00; H01J 27/02; H01J 27/08; H01J 37/32009; H01J 37/32055;
(Continued)

(56) References Cited

U.S. PATENT DOCUMENTS 4,795,482 A 1/1989 Gioffre et al.
5,457,316 A * 10/1995 Cohen ..... G01N 27/622 250/282

(Continued)

FOREIGN PATENT DOCUMENTS

JP H7-4503 1/1995
JP H11-34470 12/1999

(Continued)

OTHER PUBLICATIONS

Balcaen et al.; "Accurate determination of S in organic matrices using isotope dilution ICP-MS/MS" J. Anal. At. Spectrom., 2013, pp. 28, 33.

(Continued)

*Primary Examiner* — Nicole Ippolito

(57) ABSTRACT

To achieve an effective gas filtering in a plasma spectrometric apparatus using a gas of a comparatively high consumption flow rate, and to improve the analytical ability, there is provided a plasma spectrometric apparatus containing a sample introducer for producing and delivering an injector gas containing an analyte sample, a plasma generator for generating plasma into which the injector gas is introduced, and an analyzer disposed subsequent to the plasma generator for analyzing the analyte sample. The plasma spectrometric apparatus contains a first gas line for supplying gas to the sample introducer, a second gas line for supplying gas to the plasma generator, and a filter located in the first gas line for removing impurities contained in the gas.

15 Claims, 10 Drawing Sheets

(58) Field of Classification Search
CPC .... H01J 37/32064; H01J 49/10; H01J 49/105; H01J 49/12; H01J 49/02; H01J 49/26
USPC ..... 250/281, 282, 283
See application file for complete search history.

(56) References Cited

U.S. PATENT DOCUMENTS

2011/0210241 A1* 9/2011 Badiei ..... G05D 7/0635 250/282
2016/0111270 A1* 4/2016 Chapon ..... H01J 37/32018 250/282
2016/0320362 A1* 11/2016 Schwieters ..... G01N 33/0013

FOREIGN PATENT DOCUMENTS

JP 2013143196 A 7/2013
JP 2014183049 A 9/2014

OTHER PUBLICATIONS

Heumann "Isotope-dilution ICP—MS for trace element determination and speciation: from a reference method to a routine method?" Anal Bioanal Chem (2004) 378: pp. 318-329.
Liu et al.; "Dynamic reaction cell inductively coupled plasma mass spectrometry for determination of silicon in steel" Spectrochimica Acta Part B 58 (2003) pp. 153-157.
Martínez-Sierra et al.; "Sulfur analysis by inductively coupled plasma-mass spectrometry: A review" Spectromchimica Acta Part B 108 (2015) pp. 35-52.
Niemela et al.; "Determination of Trace Impurities in Germanium Dioxide by ICP-OES, ICP-MS and ETAAS after Matrix Volatilization: A Long-run Performance of the Method" Analytical Sciences, Jul. 2014, vol. 30, pp. 735-738.
Resano et al.; "Direct determination of sulfur in Bisphenol A at ultratrace levels by means of solid sampling-electrothermal vaporization-ICP-MS" J. Anal. At. Spectrom., 2001, 16, pp. 793-800.
Resano et al.; "Direct determination of trace amounts of silicon in polyamides by means of solid sampling electrothermal vaporization inductively coupled plasma mass spectrometry" J. Anal. At. Spectrom., 2002, 17, pp. 897-903.
Takaku et al.; "Determination of Trace Silicon in Ultra-high-purity Water by Inductively Coupled Plasma Mass Spectrometry" Journal of Analytical Atomic Spectrometry, Dec. 1994, vol. 9, pp. 1385-1387.

* cited by examiner

METHOD FOR SUPPLYING GAS FOR PLASMA BASED ANALYTICAL INSTRUMENT

RELATED APPLICATIONS

This application claims the benefit under 35 U.S.C. 119 of Japanese Patent Application No. 2016-15106, filed Jan. 29, 2016, titled "METHOD OF GAS SUPPLYING FOR PLASMA BASED ANALYTICAL INSTRUMENT," the content of which is incorporated by reference herein in its entirety.

TECHNICAL FIELD

The present invention relates to a plasma spectrometric apparatus including: an ICP analytical apparatus such as an ICP-MS (Inductively Coupled Plasma—Mass Spectrometry) apparatus and an ICP-AES (Inductively Coupled Plasma—Atomic Emission Spectrometry) apparatus; and a MIP analytical apparatus such as a MIP-MS (Microwave Induced Plasma—Mass Spectrometry) apparatus and a MIP-AES (Microwave Induced Plasma—Atomic Emission Spectrometry) apparatus. More specifically, the present invention relates to a plasma spectrometric apparatus having a device for effectively purifying and supplying gas.

BACKGROUND

A plasma spectrometric apparatus such as an ICP or MIP analytical apparatus is particularly useful for detecting a trace amount of inorganic elements, and widely used in many fields including semiconductor, geological and environmental industries. For purposes of simplification, below is provided an explanation of an ICP-MS apparatus as an example of the plasma spectrometric apparatus of the prior art. FIG. 7 shows an example of a configuration similar to the conventional inductively coupled plasma mass spectrometer (ICP-MS apparatus) shown in FIG. 3 of Patent Literature 1.

In FIG. 7, the flow rate of gas, e.g., an argon gas 704, from a gas source (not shown) is controlled by a gas flow rate control part 703. A carrier gas from the gas flow rate control part 703 and a liquid sample 702 from a sample tank 701 are introduced to a nebulizer 705, and the sample 702 is nebulized. A spray chamber 706 is installed to the nebulizer 705 through an end cap 707. In addition, a make-up gas from the gas flow rate control part 703 is supplied to the spray chamber 706 through the end cap 707. Of droplets of the nebulized sample 702, droplets with a large particle diameter are attached to an inner wall of the spray chamber 706 and dropped, and drained to the outside from a drain hole **706*a*. The liquid drained from the drain hole 706*a* is sent to a drain tank 708 through a pump 715**.

The sample nebulized in the spray chamber 706, and a mixed gas of the carrier gas and the make-up gas from the gas flow rate control part 703, that is, a gas generally-called an injector gas, are introduced to a plasma torch 709. The plasma torch 709 has a triple-tube structure including an inner tube to which the injector gas is introduced, an outer tube that is outside thereof, and an outermost tube that is further outside thereof. To the outer tube, an auxiliary gas from the gas flow control part 703 is introduced, and to the outermost tube, a plasma gas from the gas flow rate control part 703 is introduced. By inductively coupled plasma (ICP) 712 generated by a work coil 711 to which an electric current from a high frequency power source 710 is supplied, the sample 702 is ionized. Then, in a mass analyzer 713, elements in the ionized sample are separated and detected based on the mass-to-charge ratio, and the elements in the sample 702 and each element concentration are eventually obtained.

As a result of many years of technological development, it has become possible for ICP-MS apparatuses to detect a wide variety of elements at a more minute level. For example, it has become possible for ICP-MS apparatuses to quantify element concentrations at an excellent sensitivity level of one billionth (parts per billion, or ppb) or one trillionth (parts per trillion, or ppt), and a trace amount of silicon (Si), sulfur (S) or phosphorus (P), etc. contained in an analyte is also analyzed by mass spectrometry.

For example, Non-Patent Literatures 1-4 describe, respectively, performing mass spectrometry of a trace amount of silicon in an organic material such as polyamide; performing mass spectrometry of a trace amount of silicon in a metal material such as steel; performing mass spectrometry of a trace amount of silicon in a semiconductor such as GaAs semiconductor; and performing mass spectrometry of a trace amount of silicon contained in water such as ultrapure water. Further, Non-Patent Literatures 5-8 describe, respectively, performing mass spectrometry of sulfur or phosphorus contained in organic materials, oil products, pharmaceutical products, food, water, biofuels, metal materials, biological samples, high-purity reagents, geological materials, organic solvents, and others; performing mass spectrometry of a trace amount of sulfur in a semiconductor such as $GeO_2$; performing mass spectrometry of a trace amount of sulfur in an organic material such as Bisphenol A; and performing mass spectrometry of a trace amount of sulfur in organic matrices such as fuels, biomaterials, and pharmaceutical products.

PRIOR ART DOCUMENTS

Patent Literatures

Patent Literature 1: Japanese Patent Laid-Open Publication No. H11-34470

Patent Literature 2: Japanese Patent Examined Publication No. H7-4503 (or U.S. Pat. No. 4,795,482)

Patent Literature 3: Japanese Patent Laid-Open Publication No. 2014-183019

Patent Literature 4: Japanese Patent Laid-Open Publication No. 2013-143196

Non-Patent Literatures

Non-Patent Literature 1: M. Resano, M. Verstraete, F. Vanhaeck and L. Moens, "Direct determination of trace amounts of silicon in polyamides by means of solid sampling electrothermal vaporization inductively coupled plasma mass spectrometry," Journal of Analytical Atomic Spectrometry, 2002, 17, 897-903, Published on May 1, 2002 (online)

Non-Patent Literature 2: Hui-tao Liu and Shiuh-Jen Jiang, "Dynamic reaction cell inductively coupled plasma mass spectrometry for determination of silicon in steel," Spectrochimica Acta Part B: Atomic Spectroscopy, Volume 58, Issue 1, 1 January 2003, Pages 153-157

Non-Patent Literature 3: Klaus G. Heumann, "Isotope-dilution ICP-MS for trace element determination and speciation: from a reference method to a routine method?" Analytical and Bioanalytical Chemistry, January 2004, Volume 378, Issue 2, pp 318-329

Non-Patent Literature 4: Yuichi Takaku, Kimihiko Masuda, Takako Takahashi and Tadashi Shimamura, "Determination of trace silicon in ultra-high-purity water by inductively coupled plasma mass spectrometry" Journal of Analytical Atomic Spectrometry, 1994, 9, Pages 1385-1387

Non-Patent Literature 5: J. Giner Martinez-Sierra, O. Galilea San Blas, J. M. Marchante Gayon, J. I. Garcia Alonso, "Sulfur analysis by inductively coupled plasma-mass spectrometry: A review," Spectrochimica Acta Part B: Atomic Spectroscopy, Volume 108, 1 June 2015, Pages 35-52

Non-Patent Literature 6: Matti NIEMELA, Harri KOLA and Paavo PERAMAKI, "Determination of Trace Impurities in Germanium Dioxide by ICP-OES, ICP-MS and ETAAS after Matrix Volatilization: A Long-run Performance of the Method," Analytical Sciences, Vol. 30, Pages 735-738, Published on Jul. 10, 2014 (online)

Non-Patent Literature 7: M. Resano, M. Verstraete, F. Vanhaecke, L. Moens and J. Claessens, "Direct determination of sulfur in Bisphenol A at ultratrace levels by means of solid sampling-electrothermal vaporization-ICP-MS," Journal of Analytical Atomic Spectrometry, 2001, 16, Pages 793-800, Published on Jul. 12, 2001 (online)

Non-Patent Literature 8: Lieve Balcaen, Glenn Woods, Martin Resano and Frank Vanhaecke, "Accurate determination of S in organic matrices using isotope dilution ICP-MS/MS," Journal of Analytical Atomic Spectrometry, 2013, 28, Pages 33-39, Published on Nov. 12, 2012 (online)

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

Problem to be Solved by the Invention

When various elements can be detected at a more minute level as described above, it becomes necessary to consider an extremely trace amount of impurities contained in gas used in an ICP-MS apparatus. As the gas 704 supplied to the ICP-MS apparatus, gas sold by a gas provider as an industrial gas and the like is generally used, and in some cases, a self-produced industrial gas is used in a facility using an ICP-MS apparatus. These industrial gases can contain an acceptable, extremely trace amount of impurities. However, as ICP-MS apparatuses come to be able to detect components of a finer level, problems affecting analysis results can occur, such as detection of these impurities in the mass analyzer 713 as a background noise or occurring of interference by ions due to such impurities. In addition, even when the amount of impurities contained in the above industrial gases is extremely small, a trace amount of contamination attributed to piping or materials of other routes delivering the gases and others may occur and cause similar problems.

Here, in order to verify the impact of an extremely trace amount of impurities contained in gas on an analysis result in a plasma spectrometric apparatus, the amount of Si in an argon gas (volume ratio) is calculated assuming that Si of 1 ppb (1 μg/L) contained in a liquid sample as an impurity is introduced not from the sample but as the impurity in the dry argon gas constituting an injector gas. For a convenience sake, discussion is done by assuming that one Si atom is contained in one molecule of the impurity. It is assumed that all the gas flow rates (SLM: Standard Litter per Minute) are in a standard state (STP: 273.15K, 0.1 MPa), and the flow rate of the injector gas is 1.07 SLM, and the solution suction rate of the nebulizer is 0.2 g/minute (200 μL/min). In addition, the passage rate of the nebulized sample in the spray chamber is 5%. As a result, the amount of silicon introduced to plasma at the time of introducing 1 ppb solution is calculated as $1.00\times10^{-11}$ (g/min). By converting the unit of the amount of silicon introduced (g/min) and the unit of the flow rate of the dry argon gas (SLM) to (mol/min) and then performing the above calculation, the Si concentration in the gas can be obtained in a molar ratio volume ratio), and approximately 7.6 pptv is obtained as the Si concentration in the gas. In other words, when a Si impurity is contained in an amount of 7.6 pptv in an argon gas under the above condition, even if a sample solution does not contain Si, an analysis result is obtained that indicates that the sample contains 1 ppb of Si. Actually, an argon gas of 99.999% purity may contain a Si impurity of approximately 0.4 ppmv at maximum.

Conventionally, there was a case of using a gas purifying substance as described in Patent Literature 2, e.g., a filter using zeolite, in a gas line for analytical equipment using gas of comparatively low consumption (flow rate) (≤2 SLM). However, in order to remove impurities contained in the gas 704 supplied to a conventional ICP-MS apparatus such as that shown in FIG. 7, it is not appropriate, or at least not preferable, to use a conventional filter as-is. The reason is that, while the flow rate of gas supplied to a plasma spectrometric apparatus is generally approximately 20 SLM, which is high, the higher the gas flow rate, the shorter the contact time between the gas and the filter, which causes the gas to pass through the filter without impurities being sufficiently removed. It may be possible to produce a filter capable of supporting a higher flow rate, but the filter becomes much larger, and the cost also increases. Therefore, in a plasma spectrometric apparatus using gas, it is desirable to efficiently remove an extremely trace amount of impurities in the gas without increasing a load on a gas filter.

The object of the present invention is to achieve an effective gas filtering for efficiently removing the above-mentioned extremely trace amount of impurities in a plasma spectrometric apparatus using gas, and to improve the analytical ability of a system.

Means to Solve the Problem

According to the present invention, there is provided a plasma spectrometric apparatus containing a sample introducer for producing and delivering an injector gas containing an analyte sample, a plasma generator for generating plasma into which the injector gas is introduced, and an analyzer disposed subsequent to the plasma generator for analyzing the analyte sample. The plasma spectrometric apparatus contains a first gas line for supplying gas to the sample introducer, a second gas line for supplying gas to the plasma generator, and a filter located in the first gas line for removing impurities contained in the gas.

According to one aspect of the present invention, a first gas line and a second gas line can be configured to be branched or divided from a single source gas line so that the same gas is supplied. The flow rate through the first gas line is smaller than the flow rate through the second gas line, for example, by approximately from 6 SLM to 23 SLM, and preferably by from 11 SLM to 19 SLM.

A filter applied in the present invention can be any of a variety of filters which can effectively remove impurities in gas, and an example thereof can be a gas purifier for inline piping.

The first gas line can contain a gas flow rate controller between the sample introducer and the filter, in which case, along the gas flow of the first gas line, the filter is disposed upstream relative to the gas flow rate controller. However, the filter can also be disposed downstream relative to the gas flow rate controller. In addition, the gas flow rate controller can also be provided in other gas lines. The gas flow rate controller can be a mass flow controller.

According to another aspect of the present invention, the sample introducer can contain a nebulizer for producing the injector gas by mixing the analyte sample with the gas from the first gas line. The first gas line is branched or divided into a third gas line and a fourth gas line through a connector, and a part of the filtered gas and the remaining part thereof can be delivered to the sample introducer as a carrier gas and a make-up gas, respectively. The nebulizer mixes a liquid sample containing the analyte sample with the carrier gas and nebulizes the resultant mixture, at which time the make-up gas passes through an outer surface of a nozzle of the nebulizer to assist the delivery of the nebulized sample. The filter can also be provided in each of the third gas line and the fourth gas line instead of the first gas line.

The filter which can be a gas purifier can be in a form of a cartridge as an example, and replaceably connected to the first gas line or the third and the fourth gas lines. The second gas line is branched or divided into a fifth gas line and a sixth gas line through a connector, and a part of the gas passing through the second gas line and the remaining part thereof can be delivered to the plasma generator as a plasma gas and an auxiliary gas, respectively.

Instead of the sixth gas line, a seventh gas line for delivering the auxiliary gas to the plasma generator may be branched from the first gas line subsequent to the filter. The seventh gas line can be branched, for example, from the connector at which the third gas line and the fourth gas line are branched.

Additionally, an eighth gas line for delivering a dilution gas to the sample introducer may be branched from the first gas line subsequent to the filter. The eighth gas line can, for example, be branched from the connector at which the third gas line and the fourth gas line are branched. The gas flow rate controller can be provided in each of the third to the eighth gas lines, and the gas flow rate controller can be a mass flow controller.

The plasma generator can contain a plasma torch of triple-tube structure for receiving the injector gas containing a mixture of the gas from the first gas line and the analyte sample, that is, normally a mixture of the carrier gas and the make-up gas from the third and the fourth gas lines and the analyte sample, and for receiving the gas from the second gas line, that is, normally the plasma gas and the auxiliary gas from the fifth and the sixth gas lines, to generate plasma for atomizing, exciting, or ionizing the sample. The plasma gas and the auxiliary gas can be delivered to the outermost tube and the outer tube of the plasma torch, respectively, while the injector gas can be introduced to the inner tube of the plasma torch. The injector gas can also be an output from a gas chromatograph or a laser ablation device.

According to yet another aspect of the present invention, an optional gas line for supplying an option gas to the sample introducer and a second filter provided in the optional gas line for removing impurities contained in the gas can further be included. The option gas can be an oxygen-containing gas selected from the group consisting of oxygen, argon-containing oxygen, nitrogen-containing oxygen, helium-containing oxygen, and mixtures thereof. The gas supplied through each of the first and the second gas lines can be selected from the group consisting of argon, nitrogen, helium, hydrogen, and mixtures thereof.

The apparatus of the present invention can also be described from an aspect of a method. According to this aspect, the present invention is provided, in a plasma spectrometric apparatus including a sample introducer for producing and delivering an injector gas containing an analyte sample; a plasma generator for generating plasma into which the injector gas is introduced; and an analyzer disposed subsequent to the plasma generator for analyzing the analyte sample, as a method for reducing background intensity in measurements. The method includes supplying a first gas to the sample introducer through a filter for removing impurities; and supplying a second gas to the plasma generator without filtering. The first gas is supplied to the sample introducer through the first gas line of the plasma spectrometric apparatus. In addition, the second gas is supplied to the plasma generator through the second gas line of the plasma spectrometric apparatus described above.

The present invention is applicable to an inductively coupled plasma mass spectrometer, an inductively coupled plasma atomic emission spectrometer, a microwave induced plasma mass spectrometer, a microwave induced plasma atomic emission spectrometer, and the like, as long as it is a plasma spectrometric apparatus in which an injector gas containing an analyte sample is produced using gas from a gas source, and the injector gas is introduced to plasma to analyze the analyte sample.

Effect of the Invention

According to the present invention, in a plasma spectrometric apparatus such as an ICP-MS apparatus, an ICP-AES apparatus, a MIP-MS apparatus, and a MIP-AES apparatus, it is configured to filter only the gas constituting the injector gas such as the carrier gas and/or the make-up gas. This reduces background noise attributed to impurities compared to a conventional system, and improves the analytical ability of the system. In addition, as a load on the filter is low compared to a case where all the supplied gases are collectively filtered, it is possible to effectively filter the carrier gas and the make-up gas and others without causing the reduction in the filter's removing capability, and thus to prolong the life of the filter.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
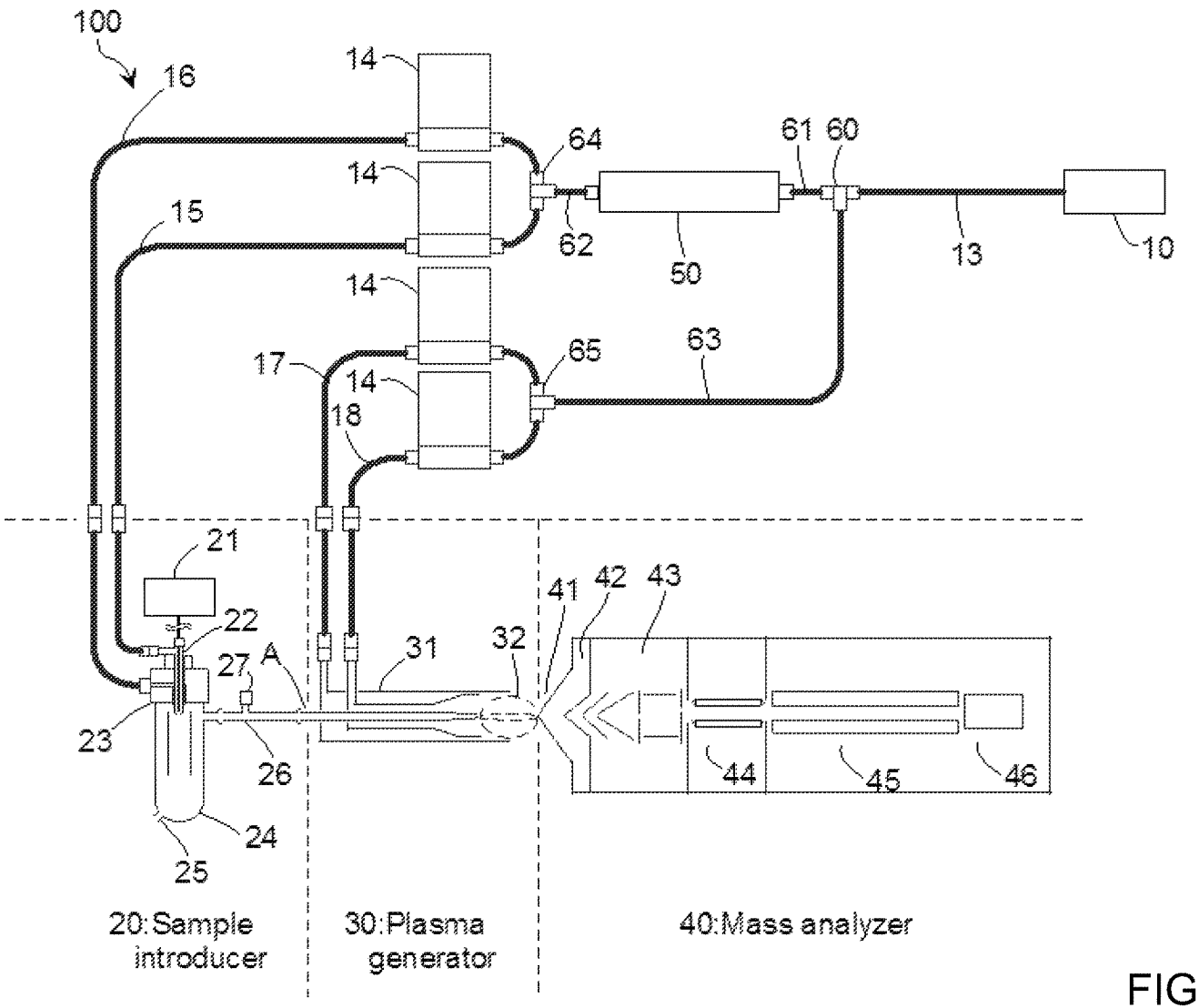
FIG. 1 is a schematic drawing showing a configuration example of an ICP-MS apparatus according to the present invention.

FIG. 1 shows, as an example of a plasma spectrometric apparatus according to the present invention, a configuration of an inductively coupled plasma mass spectrometer (ICP-MS apparatus) 100. In FIG. 1, an injector gas containing fine droplets of a liquid sample 21 is supplied to a plasma generator 30 from a sample introducer 20. Compounds and atoms existing in such fine droplets are decomposed and ionized in plasma 32. Sample ions obtained as a result are transferred to a mass analyzer 40. The mass analyzer 40 is configured such that the pressure is gradually decreased along the flow of the sample ions by using a turbo molecular pump, a rotary vacuum pump, and the like (not shown).

The sample ions are drawn to an ion lens system 43 through an orifice in an interface including a sampling cone 41 and a skimmer cone 42. Then, the sample ions are converged in a quadrupole mass spectrometer 45 through a collision/reaction cell 44. The quadrupole mass spectrometer 45 separates the sample ions based on a mass-to-charge ratio. As a device for separating the sample ions other than the quadrupole mass spectrometer, there also exist mass spectrometers of, for example, electric/magnetic sector type, flight time type, or ion trap type. The separated ions are measured by a detector 46. Such ICP-MS apparatus as the above provides means for performing a simultaneous multi-element analysis on most of the elements in the periodic table, and thus a mass spectrum can easily be obtained. In addition, such ICP-MS apparatus exhibits an excellent sensitivity such that element concentrations can be quantified at a level of one trillionth (ppt).

In FIG. 1, the mass analyzer 40 is illustrated as a mass analysis device using a quadrupole mass spectrometer. However, the mass analyzer 40 can also be an atomic emission spectrometer for observing emission spectrum of induced plasma generated in the plasma generator 30. The ICP spectrometric apparatus configured in this manner is generally referred to as an ICP-OES (Inductively Coupled Plasma—Optical Emission Spectrometry) apparatus or an ICP-AES (Inductively Coupled Plasma—Atomic Emission Spectrometry) apparatus.

In FIG. 1, a pressure-adjusted gas from a gas source 10 is supplied to a gas line 13 at a flow rate of from approximately 8 SLM to 27 SLM. The gas of the gas source is mainly an inert gas such as an argon (Ar) gas, nitrogen ($N_2$) gas, and helium (He) gas, but can be a hydrogen ($H_2$) gas, an oxygen ($O_2$) gas, and the like, or a mixed gas thereof according to the usage. In FIG. 1, only one gas source is shown, but a plurality of gas sources can also be provided. In this case, the gas of each gas source can be the same or different.

The gas line 13 from the gas source 10 is referred to as a source gas line in the present specification, and is branched or divided into gas lines 61 and 63 through a connector 60. When a plurality of gas sources exist, the gas lines 61 and 63 can be respectively connected to each of the gas sources. The gas line 61 is connected to a gas filter 50. The gas filter 50 will be explained later. The gas flowing in the gas line 61 is removed of impurities contained therein by the gas filter 50, and is supplied to a gas line 62. The gas line 62 is, as is shown in FIG. 1, branched into a gas line 15 for a carrier gas and a gas line 16 for a make-up gas through a connector 64. A gas flow rate controller 14 is provided in each of the gas lines 15 and 16. The gas flow rate controller can be a mass flow controller (MFC).

The gas line 15 is connected to a nebulizer 22 in the sample introducer 20, and the gas line 16 is connected to an end cap 23. In addition, the liquid sample 21 containing an analyte is also supplied to the nebulizer 22. As shown, the nebulizer 22 is connected to a spray chamber 24 through the end cap 23. The nebulizer 22 mixes the carrier gas from the gas line 15 with the liquid sample 21, and sprays the mixture. The make-up gas passes through a surrounding of a tip of the nebulizer 22, assists the delivery of the nebulized sample, and optimizes the ionization condition of analysis object elements in the plasma. The nebulized sample is removed of large droplets by passing through the spray chamber 24 together with the carrier gas and the make-up gas, and is sent into an ICP torch 31 in the plasma generator 30 as the injector gas (aerosol).

The gas line 63 is branched into a gas line 17 for a plasma gas and a gas line 18 for an auxiliary gas through a connector 65. In the gas lines 17 and 18, a gas flow rate controller 14 is provided. The gas flow rate controller can be a mass flow controller (MFC). According to a command from a controller of the ICP analysis apparatus or a computer, etc. (not shown), each MFC 14 measures the mass flow rate of the gas flowing in each of the gas lines 15 to 18, and controls the flow rate.

The gas lines 13, 15 through 18, and 61 through 63 are each a tube made of, for example, a stainless steel or a resin, and the inner diameter of the tube is generally from about 0.5 mm to 8 mm in diameter. From the standpoint of eliminating an extremely trace amount of impurities, such as organic silicon compounds, organic sulfur compounds, or organic halogen compounds, a tube made of a stainless steel is more preferred. The ICP torch 31 which is also referred to as a plasma torch has a triple-tube structure of quartz, and has an inner tube to which the injector gas is introduced, an outer tube which is outside the inner tube, and an outermost tube which is further outside the outer tube. The auxiliary gas is introduced to the outer tube by the gas line 18, and the plasma gas is introduced to the outermost tube by the gas line 17.

At a tip of the ICP torch 31, a work coil (not shown) which provides an energy for generating the plasma 32 is disposed, and connected to a high frequency power source (not shown). With the auxiliary gas and the plasma gas being provided to the ICP torch 31, the high frequency power can be applied to make the plasma 32 in a lighting state. The temperature of the plasma reaches from a several 1,000 K to a 10,000 K. The plasma gas is used to generate and maintain plasma. In addition, the plasma gas also functions to cool down the ICP torch 31. The auxiliary gas plays a role of protecting the inner tube and the outer tube of the ICP torch 31 by shifting a position where the plasma 32 is generated toward a downstream side. Further, there is a case where the auxiliary gas does not need to be flown depending on the form of the plasma torch. The injector gas containing fine droplets of the liquid sample is provided from the inner tube. As described above, compounds and atoms existing in such fine droplets are decomposed and ionized in the plasma 32.

As described above, industrial gases supplied by gas providers may contain an extremely trace amount of impurities, or may be contaminated by piping, and the like. It is desirable that the gas used in particular for a plasma spectrometric apparatus such as an ICP-MS apparatus, an ICP-AES apparatus, a MIP-MS apparatus, and a MIP-AES apparatus does not contain impurities such as silicon (Si), sulfur (S), phosphorus (P), boron (B), krypton (Kr), xenon (Xe), chlorine (Cl), and bromine (Br). The above gas filter 50 is a gas purifier configured to remove such impurities.

For example, such gas purifier as the above has a cylindrical structure made of metal provided with an inlet for gas flowing in and an outlet for purified gas flowing out, and a purification element for purifying the gas is filled therein. As the purification element, for impurities of organic compounds such as organic silicon compounds, organic sulfur compounds, or organic halogen compounds, it is effective to use, for example, an absorbent such as activated carbon or zeolite, or an alloy called a getter, which is like a zirconium alloy that absorbs impurities in the gas. In addition, impurities such as hydrogen sulfide can be removed by causing a chemical reaction with a metal oxide such as a copper oxide. A gas purifier like this has a service life whose length significantly differs depending on the substance to be removed, but in general, it has an ability of continuously removing impurities from an argon gas of 99.999% purity flowing at 1 SLM for from 1000 to 100,000 hours.

Figure 2A:
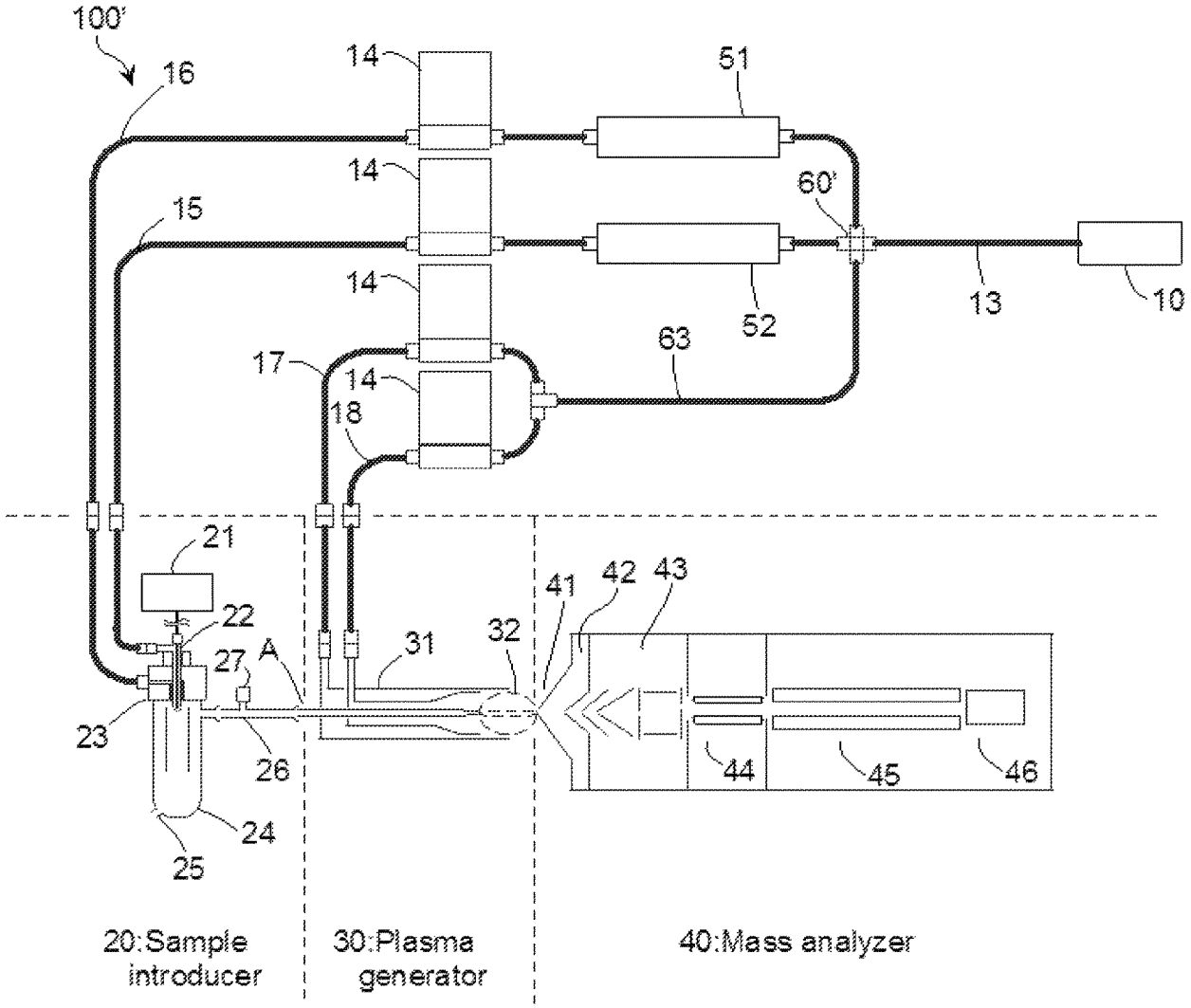
FIG. 2A is a schematic drawing showing an alternative configuration example of the ICP-MS apparatus shown in FIG. 1.
Figure 2B:
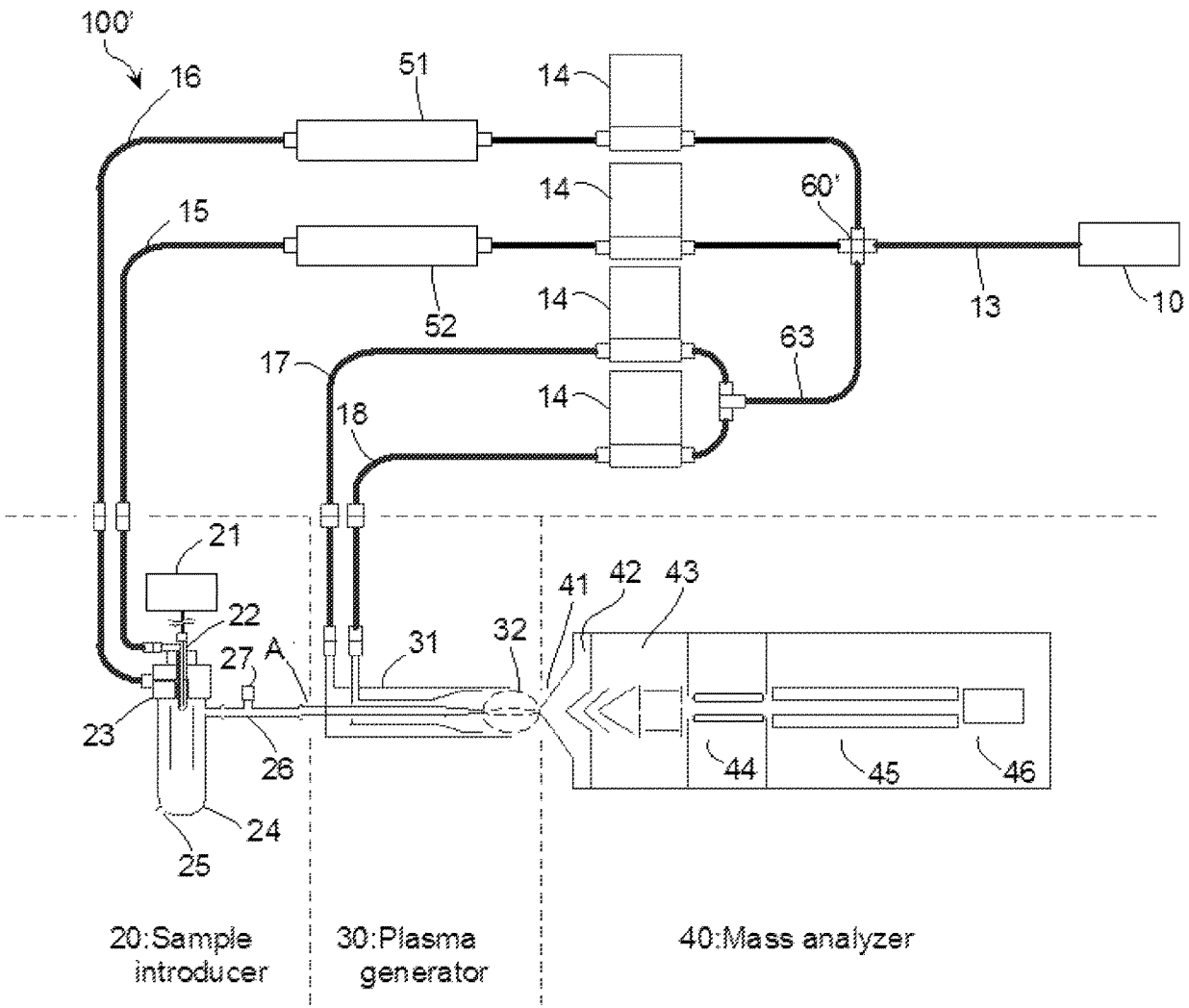
FIG. 2B is a schematic drawing showing an alternative configuration example of the ICP-MS apparatus shown in FIG. 1.

Further, the gas filter 50 can be in a form of a cartridge. The gas filter 50 can be replaceably connected to the gas lines 61 and 62 by using a connector, and the like (not shown). In FIG. 1, one gas filter 50 is shown. However, as is indicated in the alternative configurations of FIG. 2A and FIG. 2B, gas filters 51 and 52 may also be provided in the gas line 15 for the carrier gas and the gas line 16 for the make-up gas, respectively. In FIG. 2A, the gas filters 51 and 52 are provided on the inlet side of the gas flow rate controller 14. However, the gas filters 51 and 52 may also be provided on the outlet side of the gas flow rate controller 14 as shown in FIG. 2B. In addition, in FIG. 1, FIG. 2A and FIG. 2B, one gas filter is provided in each gas line, but a plurality of gas filters can also be connected serially or in parallel in order to remove a wide variety of impurities.

Figure 5:
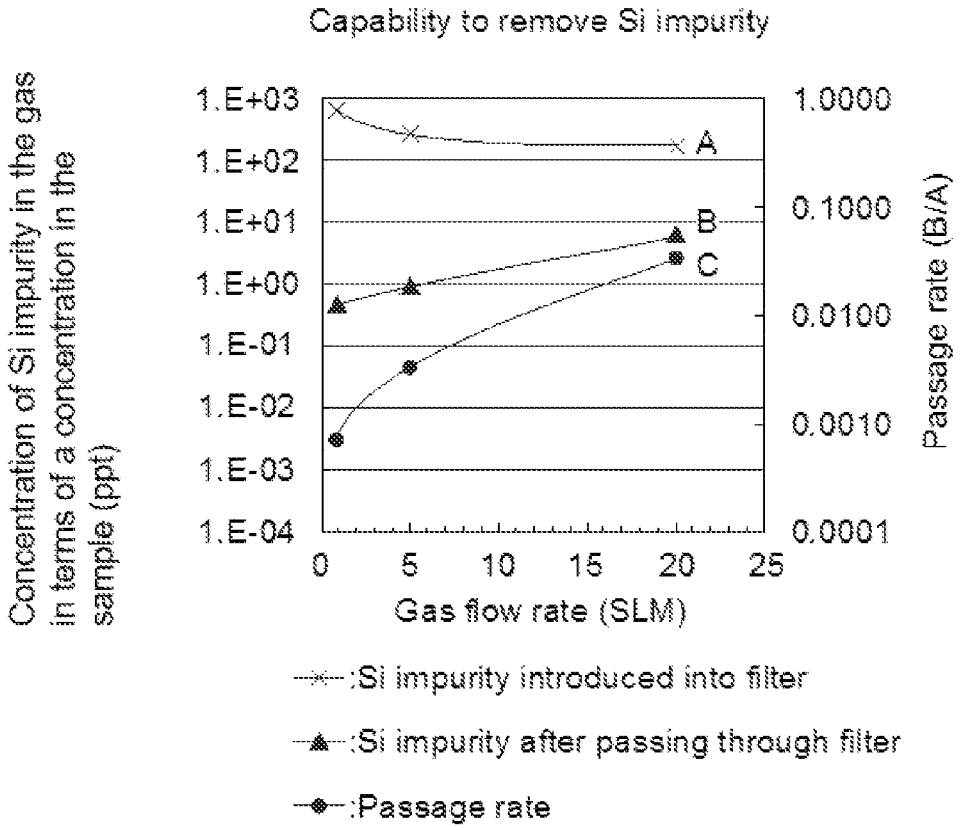
FIG. 5 is a graph showing a removing capability of a gas filter relative to a flow rate.

FIG. 5 shows a result obtained experimentally on the capability of a gas purifier itself to remove a Si impurity in consideration of a case where the gas filter 50 is configured as a gas purifier. The horizontal axis of the graph indicates a flow rate (SLM) of the gas (including the Si impurity) flowing into the gas filter. The left vertical axis of the graph indicates a value obtained by converting a concentration of the Si impurity in the gas to a concentration in the sample solution. The right vertical axis of the graph indicates a passage rate at which the Si impurity passes through the gas filter without being removed. The curve A indicates a concentration of the Si impurity introduced into the gas filter in terms of a concentration in the sample. The curve B indicates a concentration of the Si impurity that passed through the gas filter in terms of a concentration in the sample. The curve C indicates a passage rate at which the Si impurity passes through the gas filter. The passage rate is obtained by dividing the value B by the value A.

It is obvious from FIG. 5 that the higher the flow rate of the gas flowing in, the more difficult to remove the Si impurity contained in the gas by the gas filter. For example, when comparing the leftmost point corresponding to the gas flow rate of 1 SLM with the rightmost point corresponding to the gas flow rate of 20 SLM in the graph C, the passage rate differs by approximately three digits. That is, the gas filter can effectively remove impurities when the gas flow rate is low (e.g., 1 SLM).

In the ICP-MS apparatus 100 shown in FIG. 1, the gas flow rate in the gas line 15 for the carrier gas is generally from approximately 0.2 to 1.5 SLM, preferably from approximately 0.5 to 1.0 SLM, and more suitably approximately 0.7 SLM. The gas flow rate in the gas line 16 for the make-up gas is from approximately 0.0 to 1.5 SLM, preferably from approximately 0.0 to 1.0 SLM, and more preferably approximately 0.3 SLM.

Further, the gas flow rate in the gas line 17 for the plasma gas is generally from approximately 8 to 23 SLM, and preferably from approximately 12 to 20 SLM. The gas flow rate in the gas line 18 for the auxiliary gas is generally from approximately 0.0 to 2.0 SLM, and preferably approximately 1 SLM. It is considered that the gas flow rate in the gas line 62 is approximately 1 SLM, and the gas flow rate in the gas line 63 is from approximately 13 to 21 SLM.

As described above, the gas filter can effectively remove impurities when the flow rate of the gas is low (e.g., 1 SLM). In addition, an analysis result of the plasma spectrometric apparatus is less affected by impurities contained in the plasma gas and the auxiliary gas than impurities contained in the injector gas. In the present invention, the gas filter 50 is used only in the gas line 62 having a low gas flow rate, and not used in the gas line 63 having a high gas flow rate. By such configuration, it is possible to effectively remove the impurities contained in the carrier gas and the make-up gas constituting the injector gas while effectively using the filtering capability of the gas filter 50. This also reduces background noise and the like attributed to the impurities, and improves the analytical ability of the plasma spectrometric apparatus. Further, it also prevents the life of the gas filter from being shortened.

In the above explanation, the gas filter 50 is used only in the gas line 62. However, if the gas flow rate in the gas line 18 for the auxiliary gas is low, the gas line 18 for the auxiliary gas may be branched or divided from the gas line 62 instead of the gas line 63. That is, in addition to the injector gas, the auxiliary gas may also be purified by the gas filter 50. This allows to further improve the analytical ability of the plasma spectrometric apparatus.

In the ICP-MS apparatus 100 as shown in FIG. 1, when the liquid sample 21 contains many substances that are not the analysis objects (e.g., sodium chloride, magnesium chloride, etc.) such as sea water, a dilution gas for diluting the injector gas may be supplied from a gas adding inlet 27. The dilution gas can be an argon gas, and supplied to the gas adding inlet 27 through a flow rate controller such as the flow rate controller 14 after being branched from the gas line 62. The flow rate of the dilution gas is from 0 to approximately 1 SLM, and preferably from approximately 0.3 to approximately 0.8 SLM.

In addition, when a solvent of the liquid sample 21 is an organic solvent, an oxygen-containing gas may also be added as an option gas from the gas adding inlet 27 to the injector gas. When the oxygen-containing gas is introduced as the option gas, decomposition of organic matters in the plasma 32 is accelerated and accumulation of undecomposed organic matters, soot, and the like to the torch 31, the sampling cone 41, the skimmer cone 42, and the ion lens system 43 can be inhibited, thereby preventing the analytical performance from being lowered. The option gas can be supplied to the gas adding inlet 27 from a different gas source (not shown) through a gas filter such as the gas filter 50. In the present specification, a gas line delivering the option gas is referred to as an optional gas line. A flow rate controller such as the flow rate controller 14 can also be provided in the optional gas line.

The option gas can be an oxygen gas, an argon-containing oxygen gas, a nitrogen-containing oxygen gas, a helium-containing oxygen gas, and mixtures thereof. The flow rate of the option gas is from 0 to approximately 1 SLM, and preferably from approximately 0.1 to approximately 0.5 SLM. In some cases, both the dilution gas and the option gas can be supplied to the gas adding inlet 27.

When the present invention is applied to a MIP analysis apparatus, the plasma generator 30 shown in FIG. 1 is replaced by a system generating microwave induced plasma (MIP), and the plasma gas and the auxiliary gas are supplied to the plasma generator 30 in the same manner as in the ICP analysis apparatus. A system generating MIP is, for example, explained in Patent Literature 3.

Figure 3:
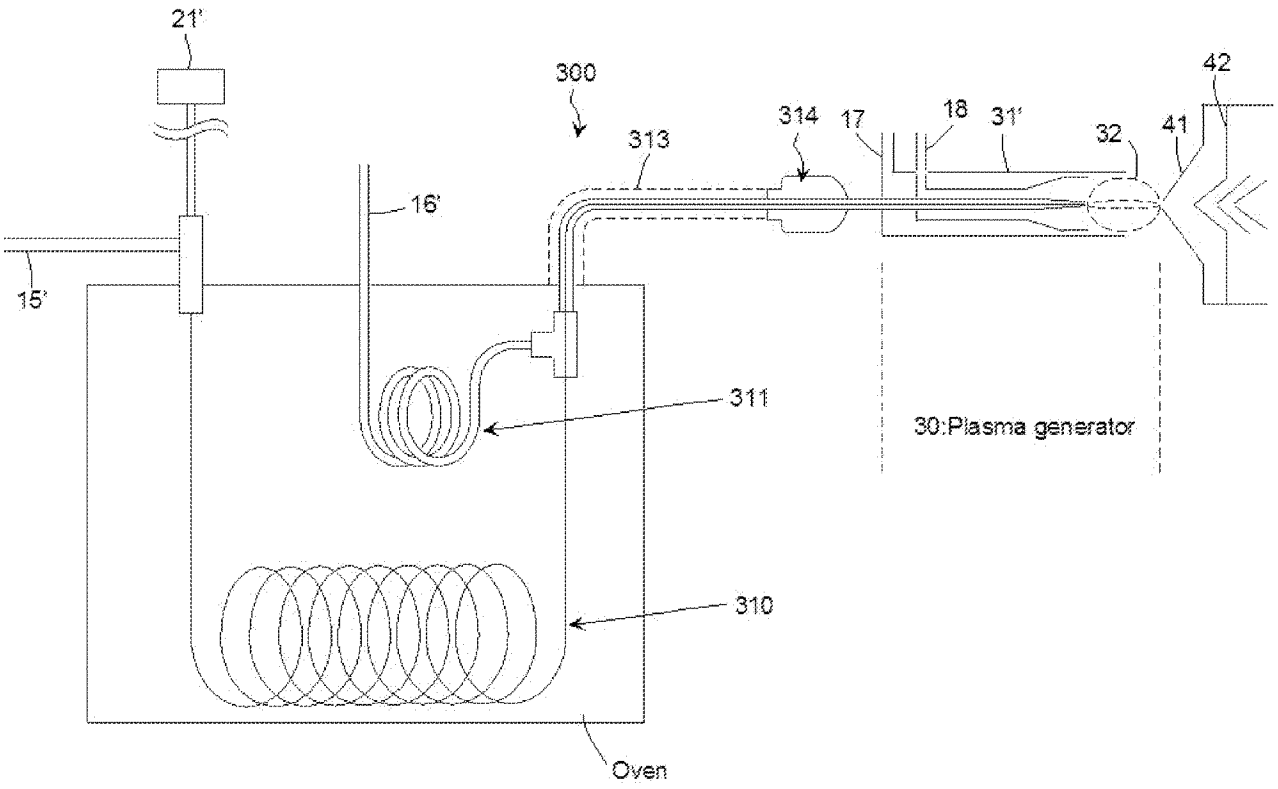
FIG. 3 is a schematic drawing showing a gas chromatograph which can be replaced with a sample introducer of the ICP-MS apparatus shown in FIG. 1.

As an alternative of the ICP-MS apparatus 100 of FIG. 1, the sample introducer 20 of FIG. 1 can be replaced by a gas chromatograph 300 shown in FIG. 3. In this case, the carrier gas or the make-up gas in the gas chromatograph can be supplied from a different gas source (not shown). A gas filter such as the gas filter 50 shown in FIG. 1 can be provided in a gas line for the carrier gas or the make-up gas from the different gas source, and can purify the carrier gas or the make-up gas.

The carrier gas in the gas chromatograph can generally be a helium (He) gas, an argon (Ar) gas, a hydrogen ($H_2$) gas, a nitrogen ($N_2$) gas, and the like. As an alternative, the carrier gas in the gas chromatograph 300 may be supplied through a gas line 15' as the gas line 15 shown in FIG. 1. In addition, the make-up gas in the gas chromatograph 300 can be supplied through a gas line 16' as the gas line 16 shown in FIG. 1. The make-up gas is a gas for achieving an optimum ionization condition in detecting an analyte element in the mass analyzer 40, and the range of the flow rate is the same as that of the carrier gas or the make-up gas used in a normal ICP analysis apparatus. Therefore, in an aspect in which the carrier gas is supplied using a different gas source, the make-up gas for the gas chromatograph 300 can be supplied through the gas line 15 or the gas line 16 as shown in FIG. 1. As is shown in FIG. 3, an output of the gas chromatograph 300 is connected to an injector 314 through a transfer line 313, and the injector 314 is inserted in a plasma torch 31' as an inner tube.

In FIG. 3, a sample 21' is introduced to a column 310 together with the carrier gas in the gas line 15'. The introduced sample is separated by each component when passing through the column 310. The make-up gas supplied through the gas line 16' passes through a preheating tube 311, which adjusts the temperature of the make-up gas. The carrier gas containing the sample separated by the column 310 and the temperature-adjusted make-up gas are mixed to produce the injector gas. The injector gas is introduced to the inner tube of the plasma torch 31' as shown in FIG. 1 through the transfer line 313 and the injector 314. The temperatures of the column 310 and the preheating tube 311 are adjusted by an oven. Further, the temperatures of the transfer line 313 and the injector 314 are adjusted by a heater and the like (not shown).

Figure 4:
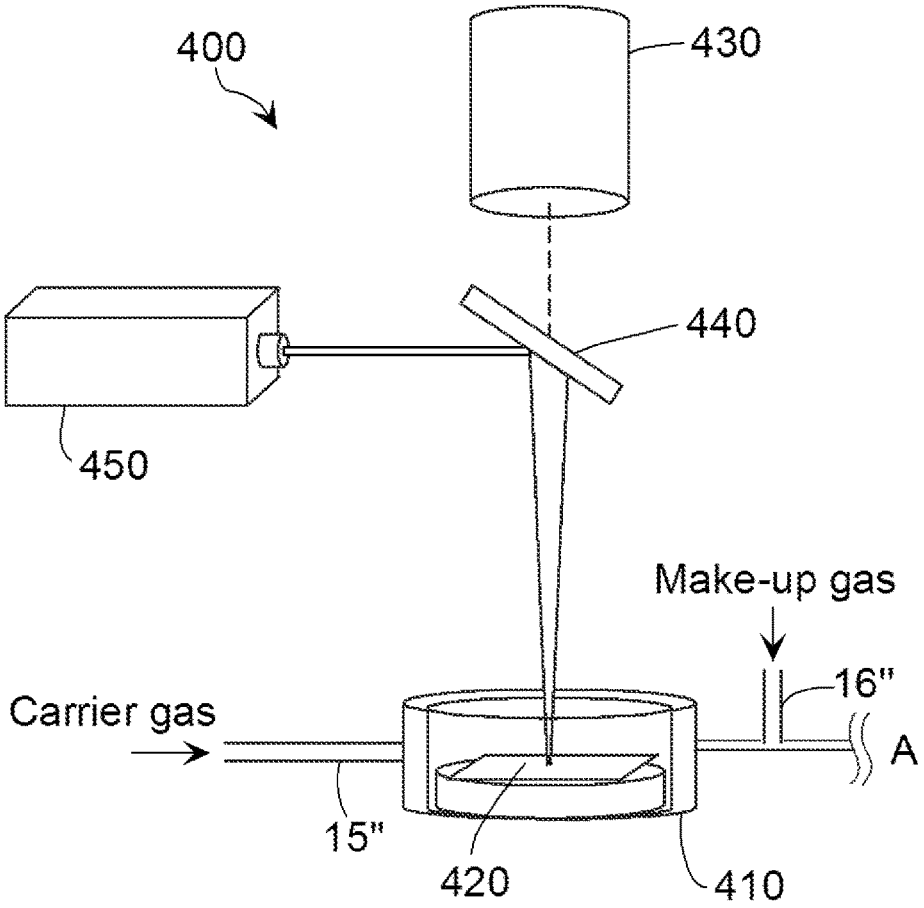
FIG. 4 is a schematic drawing showing a laser ablation apparatus which can be replaced with a sample introducer of the ICP-MS apparatus shown in FIG. 1.

As yet another alternative, the sample introducer 20 of FIG. 1 can be replaced by a laser ablation device 400 shown in FIG. 4. In this case, the gas lines 15 and 16 of FIG. 1 are connected to gas lines 15" and 16" shown in FIG. 4, respectively. In addition, the portion A shown in FIG. 1 and the portion A shown in FIG. 4 are connected. In FIG. 4, a solid sample 420 is placed in an ablation cell 410. A laser light from a laser 450 is irradiated to the surface of the solid sample 420 thorough a half mirror 440 and a lens and the like (not shown). By a CCD camera 430, portions to be analyzed in the sample can be observed. The sample evaporated and particulated by the irradiated laser light is discharged from the ablation cell 410 by the carrier gas, but in some cases, gas such as a helium (He) gas is added to the carrier gas for the purpose of optimizing the ablation condition of the sample. Then, the discharged sample is mixed with the make-up gas to become the injector gas. The injector gas is introduced to the inner tube of the plasma torch 31 shown in FIG. 1.

EXAMPLES

The impact on an analysis result by applying the present invention in an ICP-MS apparatus was experimentally verified. In the present experiment, an ICP-MS/MS apparatus such as that described in Patent Literature 4 was used in a gas supplying configuration shown in FIG. 1. In this case, a chamber was extended such that a quadrupole mass filter could be disposed between the ion lens system 43 and the collision/reaction cell 44 in the mass analyzer 40 of FIG. 1. In addition, in the ICP-MS/MS apparatus used in the experiment, a collision/reaction cell provided with an octupole was used.

The condition of the experiment was as follows. For gas as a gas source, an argon gas of 99.999% purity commercially available from Taiyo Nippon Sanso Corporation as an industrial gas was used. Then, the argon gas was used each as a plasma gas, an auxiliary gas, a carrier gas, and a make-up gas, having the flow rate of 15.0 SLM, 0.90 SLM, 0.70 SLM, and 0.37 SLM, respectively. For a gas filter, RMSH-2 commercially available from Agilent Technologies was used. As a high frequency power for generating plasma, a power of 1500 W was applied to the work coil. The introduction speed of the sample solution was approximately 200 μL/min (0.2 g/min), and the temperature of the spray chamber was 2° C. In addition, the distance between the downstream end of the work coil to the tip of the sampling cone was 4 mm. As a cell gas, a helium (He) gas was introduced at a flow rate of 1 SCCM, and a 10% ammonia (10% NH3/He) gas diluted by helium was introduced at a flow rate of 0.5 SCCM to the collision/reaction cell. Along the flow of sample ions, the mass-to-charge ratio (m/z) for passing through the first quadrupole mass filter was set to 28, and the m/z for passing through the second quadrupole mass filter was set to 44, and the ICP-MS/MS apparatus was operated as MS/MS mode. In this mode, after a Si ion ($Si^+$, m/z=28) generated in the plasma passes through the first quadrupole mass filter, it collides and reacts with an ammonia molecule in the collision/reaction cell provided with the octopole, and becomes $SiNH_2^+$ (m/z=44), which then reaches to a detector and is converted to an electric signal after passing through the second quadrupole mass filter.

Figure 6A:
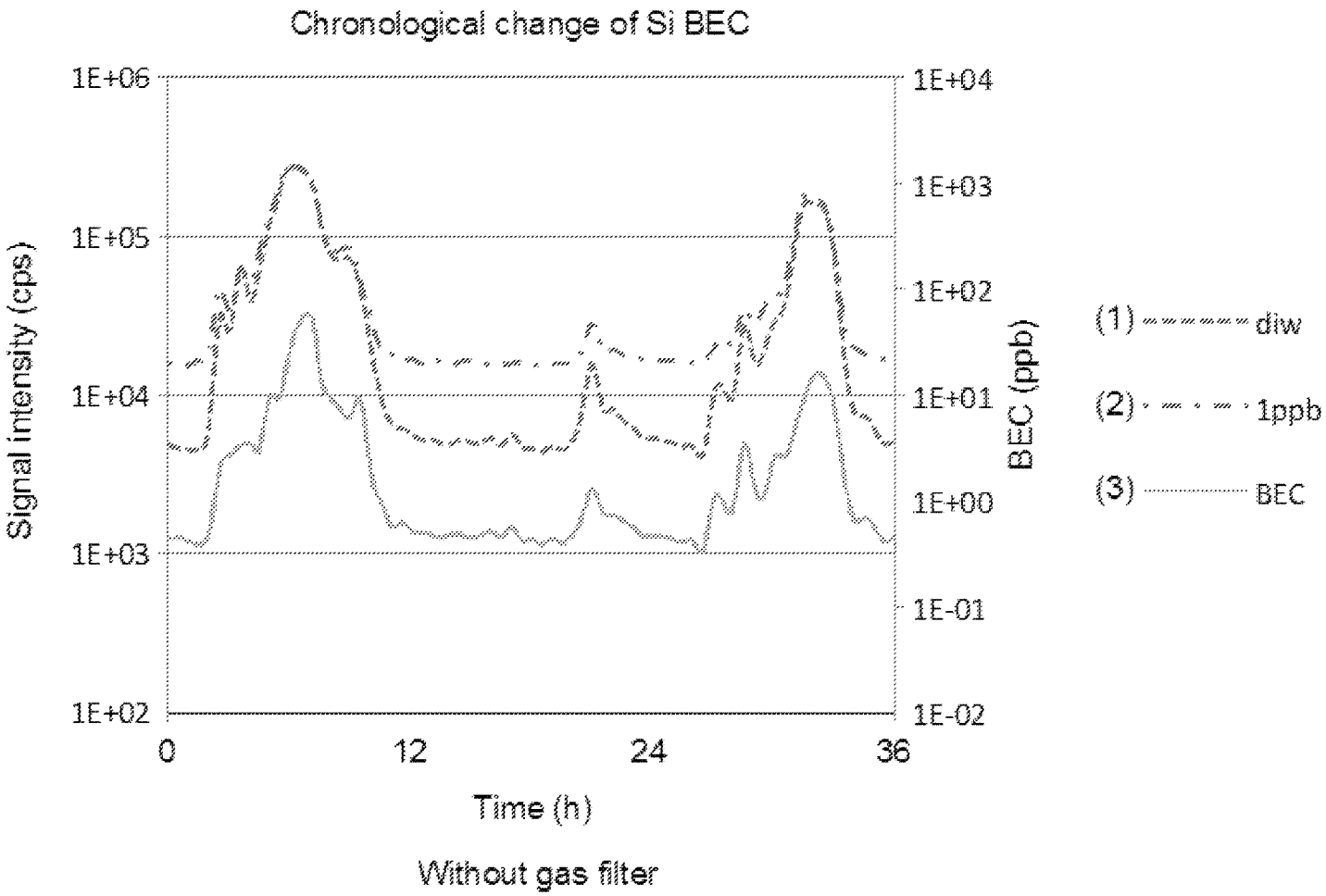
FIG. 6A is a graph showing a result of an analysis on successive chronological changes when not using a gas filter (not applying the present invention) in an ICP-MS apparatus.
Figure 6B:
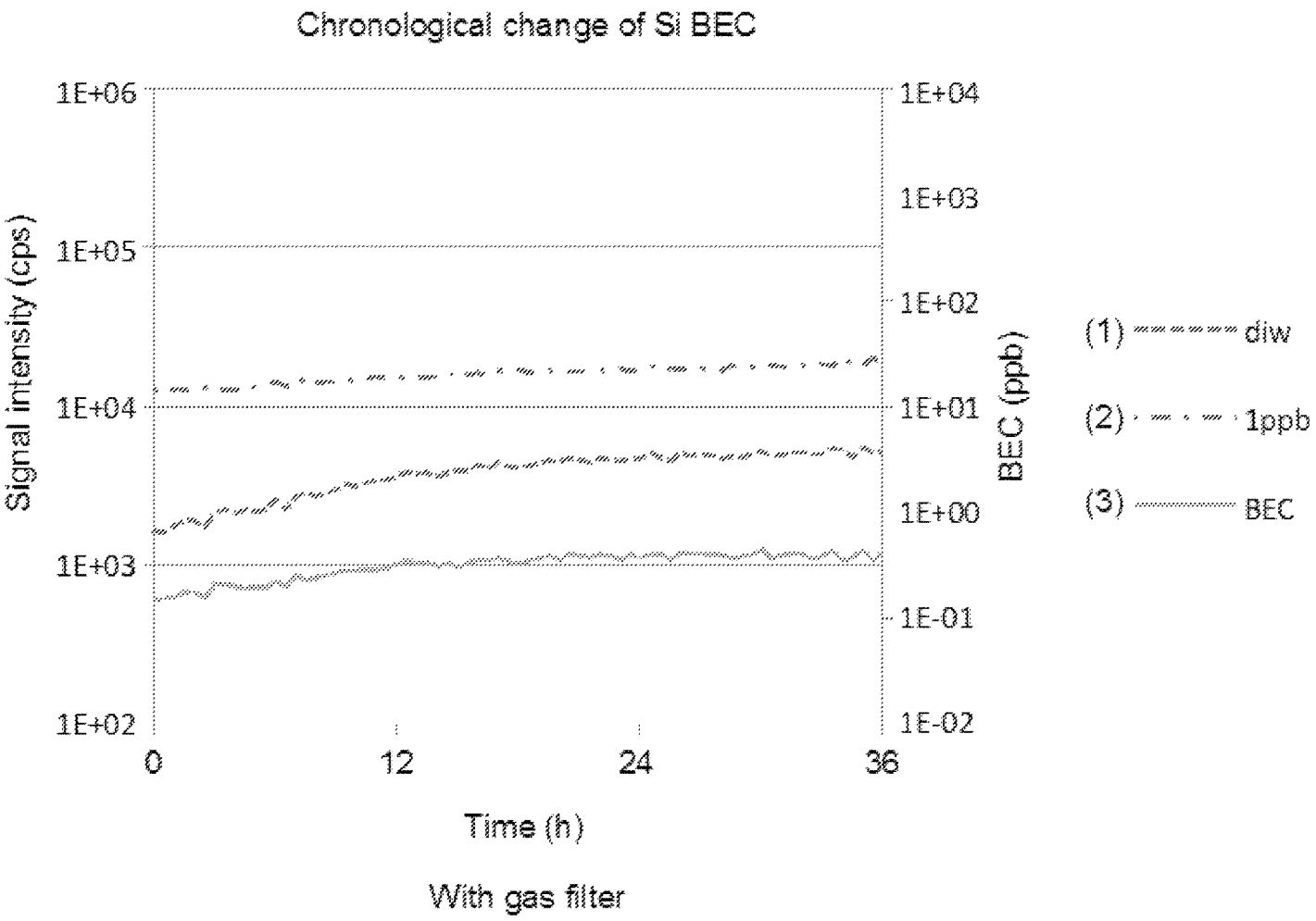
FIG. 6B is a graph showing a result of an analysis on successive chronological changes when using a gas filter (applying the present invention) in an ICP-MS apparatus.
Figure 6C:
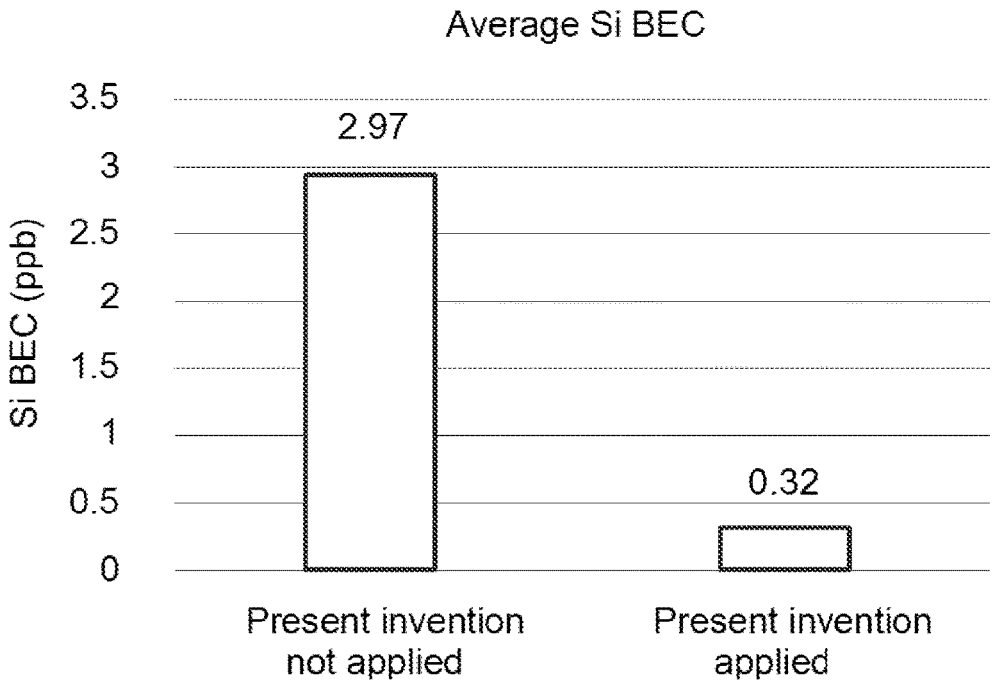
FIG. 6C is a bar graph showing the average values of the analysis results of FIGS. 6A and 6B (BEC value of Si).
Figure 7:
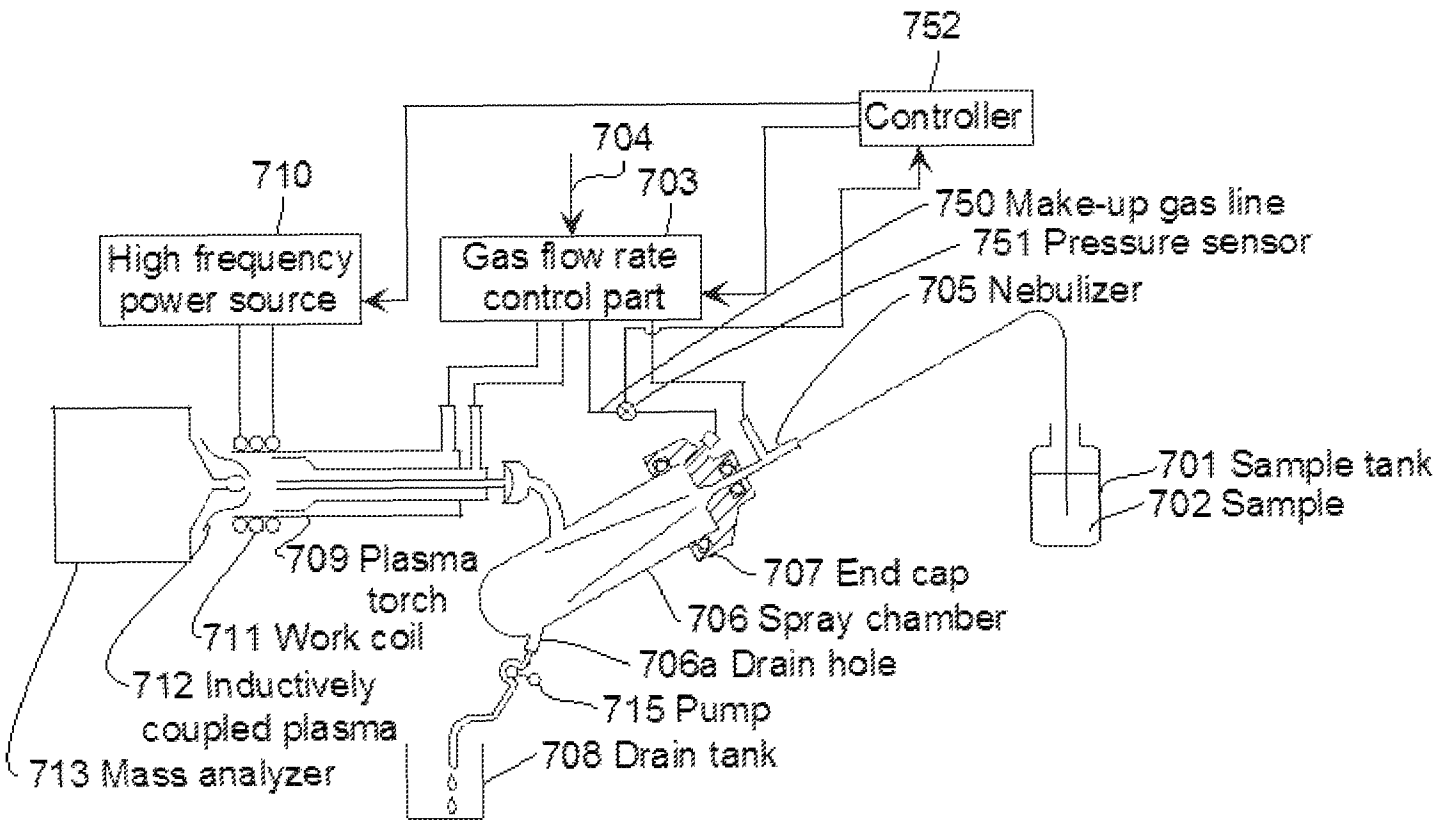
FIG. 7 (Prior art)
FIG. 7 is a schematic drawing showing a configuration example of a conventional ICP-MS apparatus.

The experiment results are shown in FIG. 6A through FIG. 6C. FIG. 6A shows a background equivalent concentration (BEC) and a signal intensity of a Si element when continuously operating, without using the gas filter 50 as in the conventional ICP-MS apparatus shown in FIG. 7, such ICP-MS apparatus for 36 hours. In this graph, the horizontal axis indicates the time (h), the left vertical axis the signal intensity, and the right vertical axis the BEC. The graph of FIG. 6B shows a BEC and a signal intensity of a Si element when continuously operating, by using the gas filter 50 as in the ICP-MS apparatus of FIG. 1, the ICP-MS apparatus for 36 hours based on the same condition as that of FIG. 6A. The horizontal axes of the graphs in FIG. 6A and FIG. 6B and the vertical axes thereof are in the same range, respectively.

In the graphs of FIG. 6A and FIG. 6B, graph (1) shows a signal intensity (the signal intensity of the background) (counts/sec) when ultrapure water (deionized water, or DIW) is introduced, and graph (2) shows a signal intensity (counts/sec) when a sample containing Si of 1 ppb (1 μg/L) is introduced into ultrapure water. Here, by subtracting (1) from (2), a net signal intensity relative to Si per 1 ppb, that is, apparatus sensitivity (counts/(sec·ppb)), can be obtained. Graph (3) can be obtained by dividing the signal intensity (1) of the background at the time of introducing ultrapure water by the apparatus sensitivity ((2)-(1)). The value shown by graph (3) indicates a background signal intensity as a concentration in a solution (ppb), and is referred to as a BEC (background equivalent concentration). The BEC value is a numerical value serving as a reference for at how low a level an analysis can be conducted in an analytical apparatus, and the smaller the value is, the lower the concentration level at which the analysis is possible.

The graph of FIG. 6A indicates that the background changes over time, showing fluctuations in a range between several 100 ppt and several 10 ppb in terms of BEC. Such changes are considered to be caused by the changes in the temperature of the piping or the flow rate of the gas flowing therein, the industrial gas lot, or the individual difference in a compressed gas cylinder contamination. Under this condition, it is possible to detect and quantify Si in a concentration range of several 100 ppb; however, it is not possible to conduct an analysis at a level of several 10 ppb, let alone an analysis at a level of ppb. On the other hand, in the graph of FIG. 6B, unlike the graph of FIG. 6A, the BEC value is stable over approximately 36 hours, and the BEC value of Si is restrained so as to be equal to or less than several 100 ppt. Thus, it is made possible to detect and quantify Si in a concentration range lower than the level of several ppt.

The average of BEC values of Si shown in FIG. 6A and FIG. 6B are 2.97 ppb and 0.32 ppb. FIG. 6C shows these average values in a bar graph. BEC represents a concentration of a measurement object element that gives a signal intensity equivalent to the background intensity. In other words, lowering of a BEC value signifies a reduction in the background noise attributed to impurities. Therefore, it was verified that removing of impurities contained in the carrier gas and the make-up gas by the gas filter 50 according to the present invention reduced, in a continuous 36-hour operation, the fluctuation in the background level and the background noise.

Below shows exemplary embodiments comprising combinations of various configuration requirements of the present invention.

1. A plasma spectrometric apparatus comprising a sample introducer for producing and delivering an injector gas containing an analyte sample, a plasma generator for generating plasma into which the injector gas is introduced, and an analyzer disposed subsequent to the plasma generator for analyzing the analyte sample, wherein the plasma spectrometric apparatus further comprises: a first gas line for supplying gas to said sample introducer; a second gas line for supplying gas to said plasma generator; and a filter located in said first gas line for removing impurities contained in the gas.

2. The plasma spectrometric apparatus according to the above 1, wherein said first gas line and said second gas line are branched from a source gas line.

3. The plasma spectrometric apparatus according to the above 1 or 2, wherein the flow rate through said first gas line is smaller than the flow rate through said second gas line.

4. The plasma spectrometric apparatus according to any one of the above 1 to 3, wherein said filter is a gas purifier.

5. The plasma spectrometric apparatus according to any one of the above 1 to 4, wherein said first gas line is provided with a gas flow rate controller between said sample introducer and said filter.

6. The plasma spectrometric apparatus according to any one of the above 1 to 5, wherein said first gas line branches into a third gas line and a fourth gas line, one delivering a carrier gas and the other delivering a make-up gas to said sample introducer.

7. The plasma spectrometric apparatus according to the above 6, wherein said filter is located in each of said third gas line and said fourth gas line.

8. The plasma spectrometric apparatus according to any one of the above 1 to 7, wherein said second gas line branches into a fifth gas line and a sixth gas line, one delivering a plasma gas and the other delivering an auxiliary gas to said plasma generator.

9. The plasma spectrometric apparatus according to any one of the above 1 to 7, wherein a seventh gas line for delivering an auxiliary gas to said plasma generator is branched from said first gas line.

10. The plasma spectrometric apparatus according to any one of the above 1 to 9, wherein an eighth gas line for delivering a dilution gas to said sample introducer is branched from said first gas line.

11. The plasma spectrometric apparatus according to any one of the above 1 to 10, further comprising: an optional gas line for supplying an option gas to said sample introducer, and a second filter located in said optional gas line for removing impurities contained in the option gas.

12. The plasma spectrometric apparatus according to any one of the above 1 to 11, wherein the gas supplied through each of said first and said second gas lines is selected from the group consisting of argon, nitrogen, helium, hydrogen, and mixtures thereof.

13. The plasma spectrometric apparatus according to the above 11, wherein said option gas is an oxygen-containing gas selected from the group consisting of oxygen, argon-containing oxygen, nitrogen-containing oxygen, helium-containing oxygen, and mixtures thereof.

14. The plasma spectrometric apparatus according to any one of the above 1 to 13, wherein said sample introducer comprises a nebulizer for producing said injector gas by mixing said analyte sample with the gas from said first gas line.

15. The plasma spectrometric apparatus according to any one of the above 1 to 13, wherein said injector gas is the output from a gas chromatograph.

16. The plasma spectrometric apparatus according to any one of the above 1 to 5, wherein, said injector gas is the output from a gas chromatograph, said first gas line delivers one of a carrier gas and a make-up gas to the gas chromatograph, the other gas is delivered to the gas chromatograph through a further gas line, and a further filter is provided in the further gas line for removing impurities from the other gas.

17. The plasma spectrometric apparatus according to any one of the above 1 to 13, wherein said injector gas is the output from a laser ablation device.

18. The plasma spectrometric apparatus according to any one of the above 1 to 17, wherein said plasma generator comprises a plasma torch for receiving the gas from said second gas line to generate plasma into which the injector gas is introduced.

19. The plasma spectrometric apparatus according to any one of the above 1 to 18, wherein said plasma generator uses inductively coupled plasma or microwave induced plasma.

20. The plasma spectrometric apparatus according to any one of the above 1 to 19, wherein said analyzer uses a mass spectrometer or an atomic emission spectrometer.

21. In a plasma spectrometric apparatus comprising a sample introducer for producing and delivering an injector gas containing an analyte sample, a plasma generator for generating plasma into which the injector gas is introduced, and an analyzer disposed subsequent to the plasma generator for analyzing the analyte sample, a method for reducing background intensity in measurements, comprising: supplying a first gas to said sample introducer through a filter for removing impurities; and supplying a second gas to said plasma generator without filtering.

22. The method according to the above 21, wherein the flow rate of said first gas is smaller than the flow rate of said second gas.

23. The method according to the above 21 or 22, wherein said first gas is used as a carrier gas and a make-up gas.

24. The method according to any one of the above 21 to 23, wherein said second gas is used as a plasma gas and an auxiliary gas.

25. The method according to the above 21 or 22, wherein said first gas is used as a carrier gas, a make-up gas, and an auxiliary gas.

26. The method according to the above 21 or 22, wherein said first gas is used as a carrier gas, a make-up gas, and a dilution gas.

27. The method according to any one of the above 21 to 26, wherein said first gas and said second gas are supplied from the same gas source.

28. The method according to any one of the above 21 to 27, wherein said filter is a gas purifier.

29. The method according to the above 21, further comprising supplying an option gas to said sample introducer through a second filter for removing impurities.

30. The method according to any one of the above 21 to 29, wherein said plasma generator uses inductively coupled plasma or microwave induced plasma.

31. The method according to any one of the above 21 to 30, wherein said analyzer uses a mass spectrometer or an atomic emission spectrometer.

EXPLANATION OF REFERENCE NUMERALS

10: Gas source
13, 15, 15', 15", 16', 16", 17, 18, 61 to 63: Gas line
14: Gas flow rate controller
20: Sample introducer
21, 21': Sample
22: Nebulizer
30: Plasma generator
31, 31': Plasma torch
40: Mass analyzer
50, 51, 52: Gas filter
100, 100': ICP-MS apparatus
300: Gas chromatograph
400: Laser ablation device It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. A plasma spectrometric apparatus comprising a sample introducer for producing and delivering an injector gas containing an analyte sample, a plasma generator for generating plasma into which the injector gas is introduced, and an analyzer disposed subsequent to the plasma generator for analyzing the analyte sample, wherein the plasma spectrometric apparatus further comprises:

a first gas line for supplying gas to the sample introducer;

a second gas line for supplying gas to said plasma generator; and a filter located in the first gas line for removing impurities contained in the gas to be supplied to the sample introducer.

2. The plasma spectrometric apparatus of claim 1, wherein said first gas line and said second gas line are branched from a source gas line.

3. The plasma spectrometric apparatus of claim 1, wherein the flow rate through said first gas line is smaller than the flow rate through said second gas line.

4. The plasma spectrometric apparatus of claim 1, wherein said filter is a gas purifier.

5. The plasma spectrometric apparatus of claim 1, wherein said first gas line branches into a third gas line and a fourth gas line, one delivering a carrier gas and the other delivering a make-up gas to said sample introducer.

6. The plasma spectrometric apparatus of claim 5, wherein said filter is located in each of said third gas line and said fourth gas line.

7. The plasma spectrometric apparatus of claim 1, wherein said second gas line branches into a fifth gas line and a sixth gas line, one delivering a plasma gas and the other delivering an auxiliary gas to said plasma generator.

8. The plasma spectrometric apparatus of claim 1, wherein a seventh gas line for delivering an auxiliary gas to said plasma generator is branched from said first gas line.

9. The plasma spectrometric apparatus of claim 1, wherein an eighth gas line for delivering a dilution gas to said sample introducer is branched from said first gas line.

10. The plasma spectrometric apparatus of claim 1, further comprising:

an optional gas line for supplying an option gas to said sample introducer, and a second filter located in said optional gas line for removing impurities contained in the option gas, wherein said option gas is an oxygen-containing gas selected from the group consisting of oxygen, argon-containing oxygen, nitrogen-containing oxygen, helium-containing oxygen, and mixtures thereof.

11. The plasma spectrometric apparatus of claim 1, wherein the gas supplied through each of said first and said second gas lines is selected from the group consisting of argon, nitrogen, helium, hydrogen, and mixtures thereof.

12. The plasma spectrometric apparatus of claim 1, wherein said sample introducer comprises a nebulizer for producing said injector gas by mixing said analyte sample with the gas from said first gas line.

13. The plasma spectrometric apparatus of claim 1, wherein said injector gas is the output from a gas chromatograph.

14. The plasma spectrometric apparatus of claim 1, wherein said injector gas is the output from a laser ablation device.

15. The plasma spectrometric apparatus of claim 1, wherein said plasma generator comprises a plasma torch for receiving the gas from said second gas line to generate plasma into which the injector gas is introduced.

* * * * *